US008369766B2

(12) United States Patent
Edure et al.

(10) Patent No.: US 8,369,766 B2
(45) Date of Patent: Feb. 5, 2013

(54) CLEANING DEVICE AND IMAGE FORMING APPARATUS

(75) Inventors: Tadakazu Edure, Tokyo (JP); Tsutomu Komiyama, Kanagawa (JP); Masaaki Takahashi, Kanagawa (JP); Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 272 days.

(21) Appl. No.: 12/554,295

(22) Filed: Sep. 4, 2009

(65) Prior Publication Data

US 2010/0221034 A1 Sep. 2, 2010

(30) Foreign Application Priority Data

Mar. 2, 2009 (JP) ..... P2009-048052

(51) Int. Cl.
*G03G 21/00* (2006.01)

(52) U.S. Cl. ..... 399/350; 399/358

(58) Field of Classification Search ..... 399/123, 399/349, 350, 358

See application file for complete search history.

(56) References Cited

U.S. PATENT DOCUMENTS 5,416,572 A * 5/1995 Kolb et al. ..... 399/350
5,442,422 A * 8/1995 Owens et al. ..... 399/103
7,010,259 B2 * 3/2006 Gila et al. ..... 399/348
2006/0216085 A1 * 9/2006 Murakami et al. ..... 399/350
2008/0193179 A1 * 8/2008 Sugimoto et al. ..... 399/354

FOREIGN PATENT DOCUMENTS

JP 05341696 A * 12/1993
JP 2004-170440 6/2004
JP 2007-033816 2/2007
JP 4045397 B 11/2007

* cited by examiner

*Primary Examiner* — Walter L Lindsay, Jr.
*Assistant Examiner* — Billy J Lactaoen
(74) *Attorney, Agent, or Firm* — Morgan, Lewis & Bockius LLP

(57) ABSTRACT

A cleaning device includes: a first scraping member that scrapes off a developer on a surface of a moving body that circularly moves; a second scraping member that is disposed downstream from the first scraping member in a moving direction of the moving body, and that scrapes off residuals remaining on the surface of the moving body; a container having: a first housing portion that houses the developer scraped off by the first scraping member, as a recovered material; and a second housing portion that houses the residuals scraped off by the second scraping member; a discharge port that is disposed in the first housing portion, wherein the developer in the first housing portion is discharged to an outside of the container through the discharge port; and a conveying member that conveys the recovered material housed in the first housing portion to the discharge port.

8 Claims, 4 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2009-048052 filed on Mar. 2, 2009.

BACKGROUND

Technical Field

The present invention relates to a cleaning device and an image forming apparatus.

SUMMARY

According to an aspect of the invention, there is provided a cleaning device including: a first scraping member which scrapes off a developer on a surface of a moving body which circularly moves; a second scraping member which is disposed downstream from the first scraping member in a moving direction of the moving body, and which scrapes off residuals remaining on the surface of the moving body; a container having: a first housing portion which houses the developer scraped off by the first scraping member, as a recovered material; and a second housing portion which houses the residuals scraped off by the second scraping member; a discharge port which is disposed in the first housing portion, and through which the developer in the first housing portion is discharged to an outside of the container; and a conveying member which conveys the recovered material housed in the first housing portion to the discharge port.

BRIEF DESCRIPTION OF THE DRAWINGS

Exemplary embodiment of the present invention will be described in detail based on the following figures, wherein.

DESCRIPTION OF REFERENCE NUMERALS AND SIGNS

10 . . . image forming apparatus, 11 . . . case, 12A, 12B . . . sheet feed tray, 13 . . . discharge tray, 14 . . . sheet conveying path, 15 . . . secondary transfer belt, 16 . . . fixing device, 20 . . . image forming unit, 21Y, 21M, 21C, 21K . . . photosensitive member, 22Y, 22M, 22C, 22K . . . charging device, 23Y, 23M, 23C, 23K . . . exposing device, 24Y, 24M, 24C, 24K . . . developing device, 25Y, 25M, 25C, 25K . . . primary transfer roll, 26Y, 26M, 26C, 26K . . . photosensitive member cleaning device, 27Y, 27M, 27C, 27K . . . discharging device, 30 . . . driving roll, 31A to 31C . . . buck-up roll, 32 . . . driven roll, 33 . . . intermediate transfer belt, 40 . . . belt cleaning device, 41 . . . container, 41*a* . . . opening, 41*b* . . . pocket, 42 . . . brush roll, 43 . . . seal member, 44A . . . first scraping member, 44B . . . second scraping member, 45A . . . first housing portion, 45B . . . second housing portion, 46 . . . gear train, 47 . . . conveying member, 48 . . . discharging portion, 140 . . . pickup roll, 141 . . . separating roll, 142 . . . conveying roll, 240 . . . housing, 241 . . . developing roller, 242 . . . supply auger, 243 . . . stir auger, 410 . . . partitioning member, 410*a* . . . projection, 411 . . . screw, 412 . . . attachment member, 413 . . . screw, 414 . . . attachment member, 415 . . . protective member, 416 . . . plate nut, 417, 418 . . . screw, 420 . . . rotation shaft, 421 . . . bristle, 460 . . . gear supporting plate, 461 . . . first gear, 462 . . . second gear, 463 . . . third gear, 464 . . . fourth gear, 465 . . . fifth gear, 466 . . . sixth gear, 470 . . . rotation shaft, 471 . . . vane, P . . . sheet

DETAILED DESCRIPTION

Figure 1:
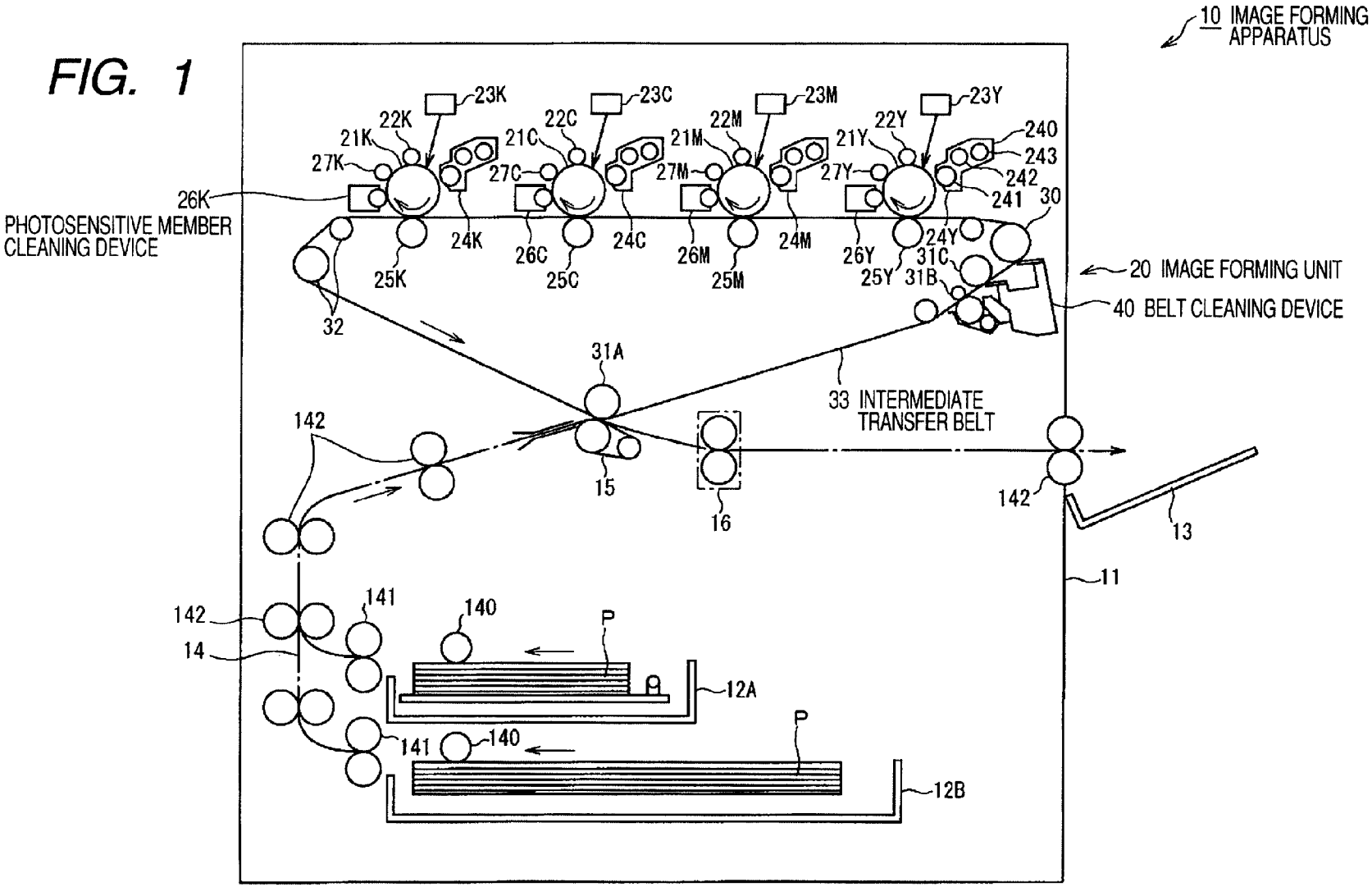
FIG. 1 is a diagram showing an example of an image forming apparatus of an exemplary embodiment of the invention.

FIG. 1 is a diagram showing an example of an image forming apparatus of an exemplary embodiment of the invention. For example, the image forming apparatus 10 is a digital color printer, and configured so that an image processing unit (not shown) applies image processing to image data transmitted from a host apparatus such as a personal computer to convert the data to color image data of yellow (Y), magenta (M), cyan (C), and black (K), and then a color image is formed on a sheet on the basis of the color image data. The image forming apparatus 10 may be a copier, a facsimile apparatus, or a multi-function apparatus having a plurality of functions of a copier, a printer, a scanner, a facsimile apparatus, and the like.

The image forming apparatus 10 has a case 11 having a substantially box-like shape. Sheet feed trays 12A, 12B which house sheets P functioning as recording media are detachably disposed in a lower portion of the case 11. In an upper portion of the case 11, a discharge tray 13 onto which a recorded sheet P is discharged is disposed, and a sheet conveying path 14 is formed so as to extend from the sheet feed trays 12A, 12B to the discharge tray 13. Pickup rolls 140 which take in the sheets P one by one from the sheet feed trays 12A, 12B to the sheet conveying path 14, separating rolls 141 which separate the sheets P taken in by the pickup rolls 140, and conveying rolls 142 which convey the sheet P are disposed on the sheet conveying path 14. Furthermore, a secondary transfer belt 15 and fixing device 16 which will be described later are disposed on the path.

In the image forming apparatus 10, an image forming unit 20 is placed above the sheet feed trays 12A, 12B in the case 11. The image forming unit 20 includes: photosensitive members 21Y, 21M, 21C, 21K which are rotated in the direction of the arrow in the figure, and on which developer images of yellow (Y), magenta (M), cyan (C), and black (K) are formed; charging devices 22Y, 22M, 22C, 22K which uniformly charge the surfaces of the photosensitive members 21Y, 21M, 21C, 21K; exposing devices 23Y, 23M, 23C, 23K which irradiate the charged photosensitive members 21Y, 21M, 21C, 21K with exposure light beams that are modulated on the basis of the color image data of YMCK, thereby forming electrostatic latent images of YMCK; and developing devices 24Y, 24M, 24C, 24K which develop the electrostatic latent images with developers to form developer images on the surfaces of the photosensitive members 21Y, 21M, 21C, 21K.

The developing devices 24Y, 24M, 24C, 24K have housings 240 which house the developers, respectively. In the housings 240, developing rollers 241 which supply the developers to the photosensitive members 21Y, 21M, 21C, 21K to develop the electrostatic latent images on the photosensitive members 21Y, 21M, 21C, 21K with the developers, supply augers 242 which supply the developers to the developing rollers 241, and stir augers 243 which stir the developers, and which supply the developers to the supply augers 242 are disposed. The color developers are supplied from developer boxes (not shown) which are disposed for the respective colors of YMCK, to the developing devices 24Y, 24M, 24C, 24K. In the exemplary embodiment, the developers contain magnetic carriers, but alternatively may not contain carriers.

The image forming unit 20 includes: photosensitive member cleaning devices 26Y, 26M, 26C, 26K which recover developers remaining on the surfaces of the photosensitive members 21Y, 21M, 21C, 21K after the transferring process; and discharging devices 27Y, 27M, 27C, 27K which discharge the photosensitive members 21Y, 21M, 21C, 21K after the transferring process.

The image forming unit 20 includes an intermediate transfer belt 33 wound around a driving roll 30, buck-up rolls 31A to 31C, and driven rolls 32. The intermediate transfer belt 33 circularly moves in the direction of the arrow in the figure while being contacted with the photosensitive members 21Y, 21M, 21C, 21K. For example, a belt which is mainly made of a polyimide resin is used as the intermediate transfer belt 33.

Primary transfer rolls 25Y, 25M, 25C, 25K are disposed on the opposite side of photosensitive members 21Y, 21M, 21C, 21K across the intermediate transfer belt 33. In nip regions which are formed by the rolls and the photosensitive members 21Y, 21M, 21C, 21K, the developer images on the surfaces of the photosensitive members 21Y, 21M, 21C, 21K are transferred to the intermediate transfer belt 33 by a pressing force and an electrostatic force.

The above-described secondary transfer belt 15 is disposed on the opposite side of buck-up roll 31A across the intermediate transfer belt 33. In a nip region which is formed by the belt and the buck-up roll 31A, the developer image on the intermediate transfer belt 33 is secondary-transferred to the sheet P.

The developer image which is transferred to the sheet P is fixed by the fixing device 16, and the sheet is then discharged to the discharge tray 13.

In the image forming unit 20, on the upstream side of the photosensitive member 21Y which is placed along the conveying direction of the intermediate transfer belt 33, a belt cleaning device 40 is disposed on the opposite side of driving roll 30 and buck-up rolls 31B and 31C across the intermediate transfer belt 33, and the belt cleaning device 40 is pressed toward the driving roll 30 and the buck-up rolls 31B and 31C, thereby scraping off and recovering the developer remaining on the intermediate transfer belt 33.

Figure 2:
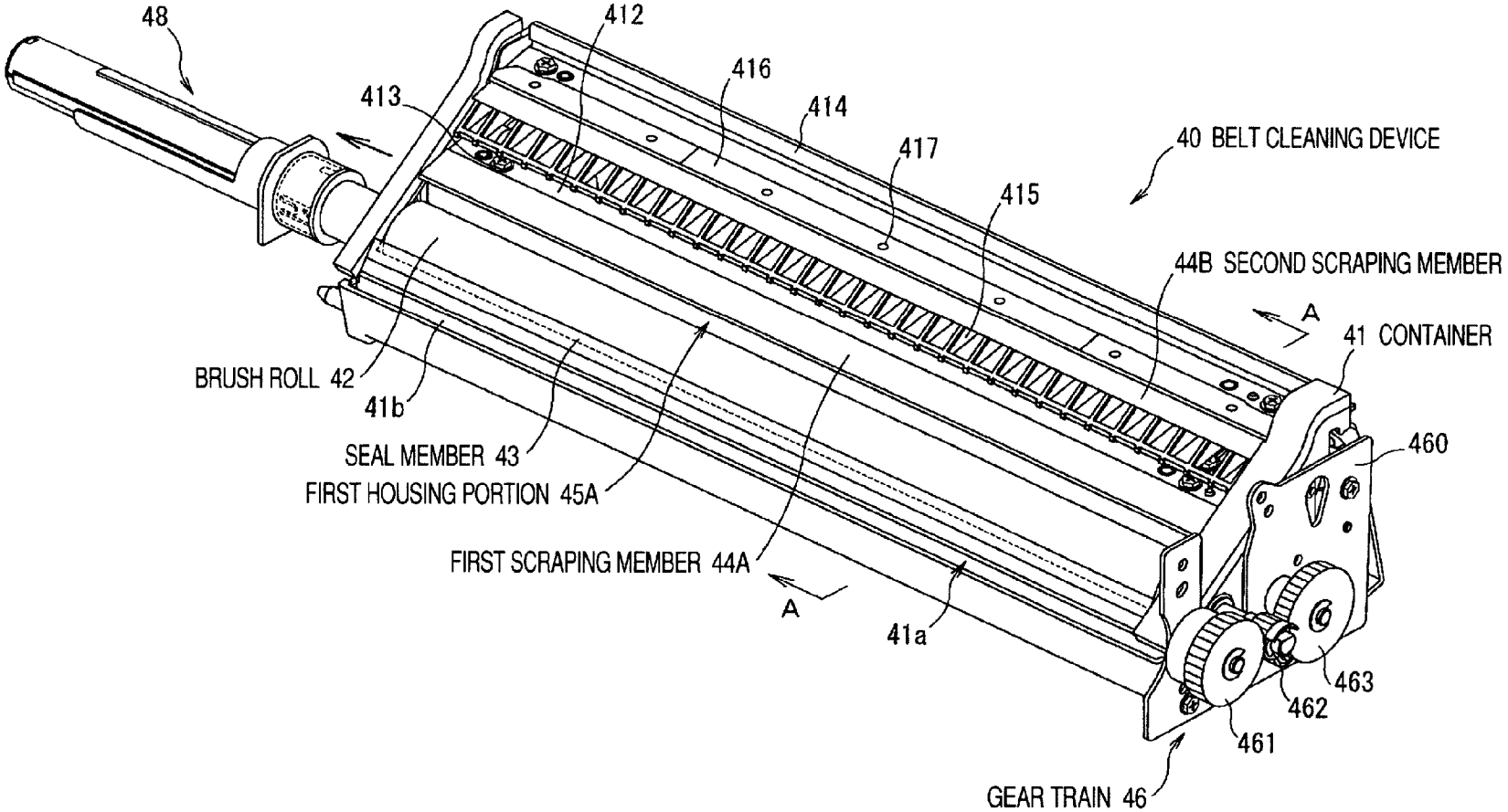
FIG. 2 is a perspective view schematically showing the configuration of a belt cleaning device of the exemplary embodiment of the invention.

FIG. 2 is a perspective view schematically showing the configuration of the belt cleaning device 40. The belt cleaning device 40 has a container 41 in which an opening 41*a* is formed on the side of the intermediate transfer belt 33. In the opening 41*a* of the container 41, from the upstream of the intermediate transfer belt 33 toward the downstream, a brush roll 42, a first scraping member 44A, and a second scraping member 44B are placed so as to be contacted with the surface of the intermediate transfer belt 33. In front of the brush roll 42, a seal member 43 which prevents the developer scattered by the brush roll 42 from returning toward the front side is placed. The brush roll 42, the first scraping member 44A, and the second scraping member 44B will be described later in detail.

The belt cleaning device 40 includes: a first housing portion 45A which houses the developer scraped off by the first scraping member 44A, as a recovered material; a second housing portion 45B which is disposed downstream from the first scraping member 44A in the moving direction of the intermediate transfer belt 33, which houses the residuals that remain on the surface of the intermediate transfer belt 33, and that are scraped off by the second scraping member 44B, and which will be described later; a gear train 46 which rotatingly drives the brush roll 42 and a conveying member 47 that will be described later; a gear supporting plate 460 which rotatably supports a part of the gear train 46; a motor which rotatingly drives the gear train 46, and which is not shown; and a discharging portion 48 which is disposed outside the container 41, and which discharges the recovered material that is conveyed by the gear train 46 in the direction of the arrow in the figure, into a waste toner tank (not shown).

Figure 3:
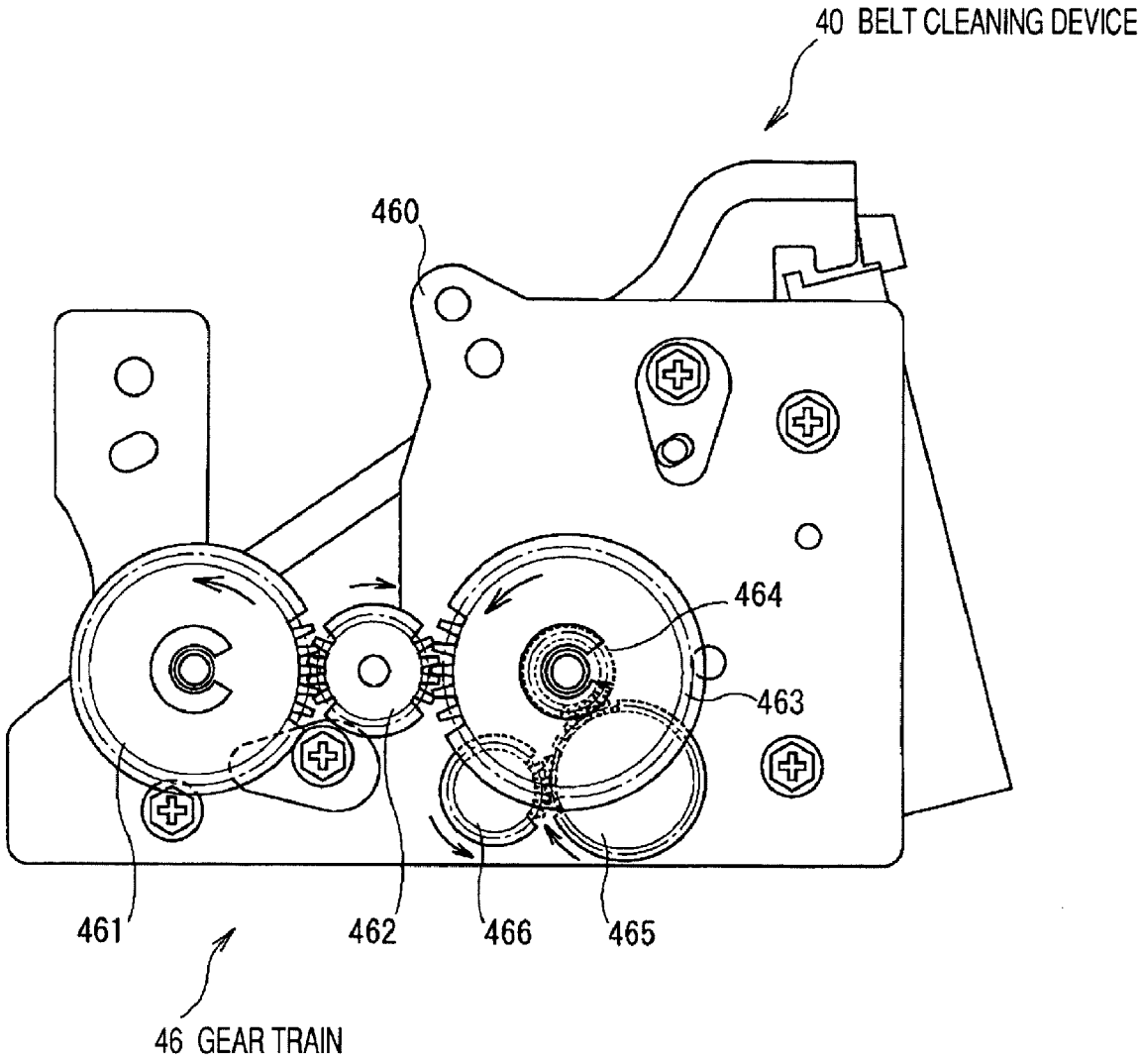
FIG. 3 is a front view of the belt cleaning device shown in FIG. 2.

FIG. 3 is a front view of the belt cleaning device 40 shown in FIG. 2. The gear train 46 includes: a first gear 461 which is rotatably disposed on the gear supporting plate 460, and which is rotatingly driven by the motor (not shown); a second gear 462 which meshes with the first gear 461, and which is fixed to the shaft of the brush roll 42; a third gear 463 which is rotatably disposed on the gear supporting plate 460, and which meshes with the second gear 462; a fourth gear 464 which is disposed coaxially with the third gear 463 to be rotated together with the third gear 463; a fifth gear 465 which is rotatably disposed on the gear supporting plate 460, and which meshes with the fourth gear 464; and a sixth gear 466 which is fixed to one end portion of a shaft 470 of the conveying member 47, and which meshes with the fifth gear 465.

Figure 4:
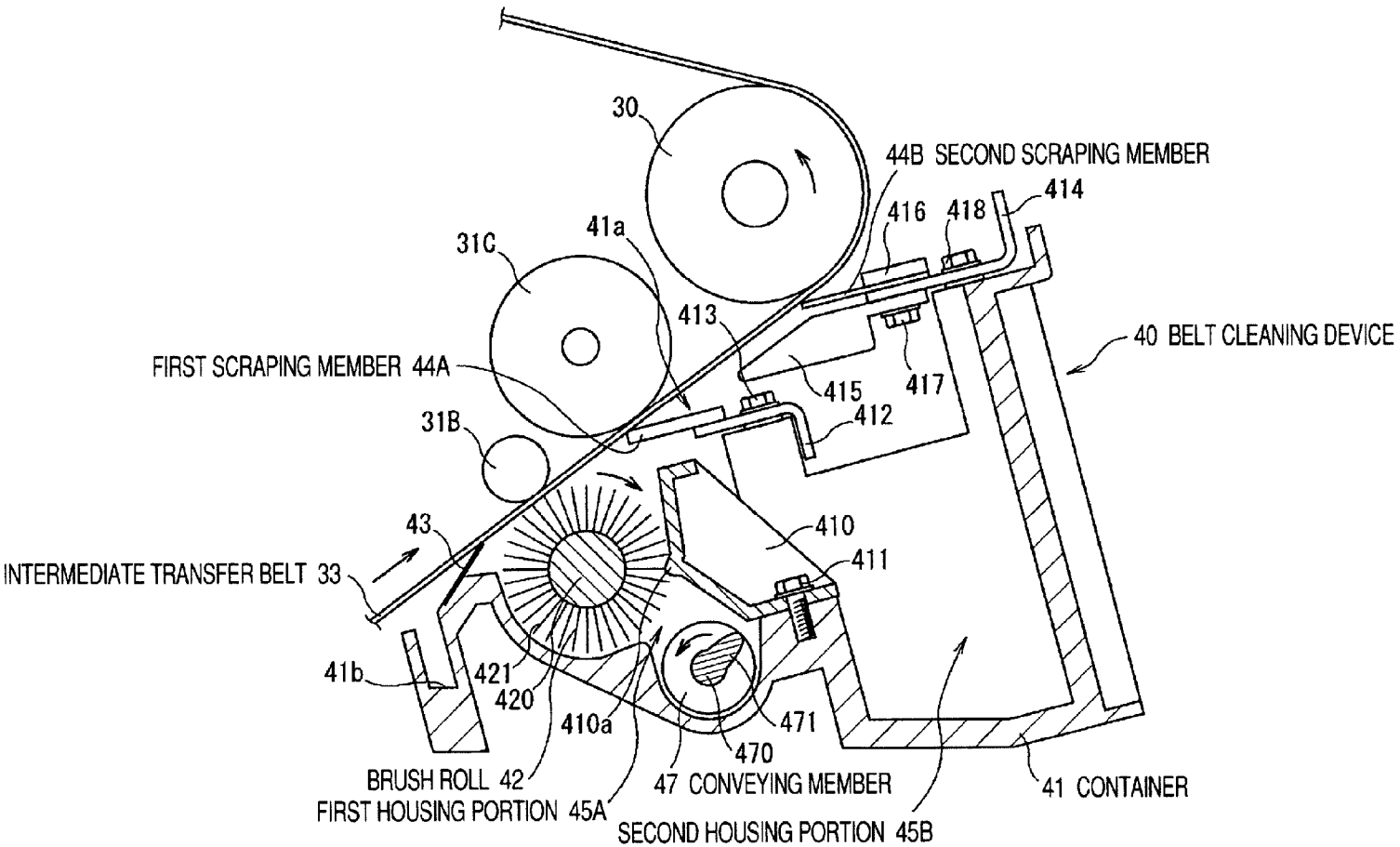
FIG. 4 is a section view taken along line A-A in FIG. 2.

FIG. 4 is a section view taken along line A-A in FIG. 2. FIG. 4 shows also the intermediate transfer belt 33. The conveying member 47 includes the rotation shaft 470, and a vane 471 which is spirally formed on the peripheral face of the rotation shaft 470. The sixth gear 466 is fixed to the one end portion of the rotation shaft 470, and the other end portion extends in the discharging portion 48. The vane is not required to be spirally disposed on the rotation shaft 470. Alternatively, a plurality of feeding plates may be inclinedly disposed on the rotation shaft 470.

In the container 41, the internal space is partitioned into two spaces by a partitioning member 410, whereby the first and second housing portions 45A, 45B are formed. The partitioning member 410 has a projection 410*a* so as to be contacted with the brush roll 42, and is attached to the container 41 by a screw 411.

The seal member 43 is formed by a resin such as PET (polyethylene terephthalate) having a thickness of about 0.01 to 0.5 mm. Materials which are obtained by the phenomenon that residuals remaining on the surface of the intermediate transfer belt 33 are contacted with the seal member 43 and caused to drop are housed in a pocket 41*b* which is formed in front of the container 41.

The brush roll 42 has many bristles 421 which extend from a rotation shaft 420 in a radial manner, and which are made of a resin, a metal, or the like. The bristles 421 are contacted with the surface of the intermediate transfer belt 33 to function so as to, among residuals remaining on the surface of the intermediate transfer belt 33, scatter powders such as toners and paper dusts. The buck-up roll 31B is placed on the side opposed to the brush roll 42 across the intermediate transfer belt 33, and the bristles 421 of the brush roll 42 are pressed against the intermediate transfer belt 33 by a constant pressing force.

(First Scraping Member)

The first scraping member 44A is configured by an elastic member made of a material having elasticity such as rubber or a silicone resin. In the exemplary embodiment, an elastic blade made of thermoplastic polyurethane rubber having a thickness of about 2 mm is used. The first scraping member 44A is bonded and fixed to an attachment member 412 which is bent into an L-like shape. The attachment member 412 is attached to the container 41 by a screw 413.

The buck-up roll 31C is placed on the side opposed to the first scraping member 44A across the intermediate transfer belt 33, and the first scraping member 44A is pressed against the intermediate transfer belt 33 by a constant pressing force. The first scraping member 44A is contacted with the surface of the intermediate transfer belt 33 to, among residuals remaining on the surface of the intermediate transfer belt 33, scrape off powders such as toners, paper dusts, and carriers.

(Second Scraping Member)

The second scraping member 44B is made of a material which is lower in elasticity than the first scraping member 44A, such as a metal material. In the exemplary embodiment, a metal-made scraper made of SUS304 having a thickness of about 0.15 mm is used as the second scraping member. The material of the second scraping member 44B is not restricted to a metal, and may be a non-metal such as a hard resin or ceramics. Alternatively, a plurality of metal scrapers may be overlappingly used. The second scraping member 44B is sandwiched between a protective member 415 and a plate nut 416, and fixed by a screw 417 to an attachment member 414 which is bent into an L-like shape. The attachment member 414 is attached to the container 41 by a screw 418.

The second scraping member 44B is pressed against the intermediate transfer belt 33 by a constant pressing force. The second scraping member 44B scrapes off residuals which slip through the first scraping member 44A, i.e., scraping residues other than powders of toners, carriers, external additives, waxes, discharge products, etc.

The protective member 415 has a function of preventing the fingers from being injured by the tip end of the second scraping member 44B.

(Operation of Belt Cleaning Device)

Next, the operation of the belt cleaning device 40 will be described.

Residuals remaining on the intermediate transfer belt 33 include toners, carriers, paper dusts, external additives, waxes, discharge products, etc.

The gear train 46 of the belt cleaning device 40 is rotatingly driven by the motor which is not shown, the second gear 462 is rotated in the right direction in FIG. 3, and also the brush roll 42 is rotated in the right direction. The sixth gear 466 is rotated in the left direction in FIG. 3, and also the conveying member 47 fixed to the axial end of the sixth gear 466 is rotated in the left direction.

Residuals remaining on the surface of the intermediate transfer belt 33 are scattered by the brush roll 42. In this case, among the residuals, powders of toners and paper dusts are scattered.

Next, the residuals remaining on the surface of the intermediate transfer belt 33 are scraped off by the first scraping member 44A to be housed in the first housing portion 45A. In this case, powders of toners, paper dusts, and carriers are scraped off.

Then, residuals which slip through the first scraping member 44A are scraped off by the second scraping member 44B to be housed in the second housing portion 45B. Residuals which slip through the first scraping member 44A are residuals such as toners, carriers, external additives, waxes, and discharge products in a form other than powders, and include materials that lower the fluidity of the recovered materials, i.e., external additives, waxes, and discharge products. External additives enter bearings of the conveying member 47 to cause bearing galling. Residuals other than powders do not enter the recovered materials which are housed in the first housing portion 45A, and are housed in the second housing portion 45B.

The recovered materials which are housed in the first housing portion 45A are conveyed toward the discharging portion 48 by rotation of the conveying member 47, and then discharged into the waste toner tank (not shown) through a discharge port which is disposed below the discharging portion 48. Materials which are prone to aggregation are not conveyed together with the recovered developer, and hence aggregation can be suppressed and the fluidity can ensured as compared with the case where such materials are conveyed together with the recovered developer.

The invention is not restricted to the exemplary embodiment, and may be variously modified without departing from the spirit of the invention. In the above, for example, the exemplary embodiment in which the invention is applied to a belt cleaning device has been described. Alternatively, the invention may be applied to a photosensitive member cleaning device. In the above, the exemplary embodiment in which the moving body to be cleaned is an intermediate transfer belt has been described. Alternatively, the moving body may be another member such as a transfer roll.

What is claimed is:

1. A cleaning device comprising:

a blade-shaped first scraping member that scrapes off a developer on a surface of a moving belt that circularly moves;

a blade-shaped second scraping member that is disposed downstream from the first scraping member in a moving direction of the moving belt and is oriented in a plane parallel to the first scraping member, and that scrapes off residuals remaining on the surface of the moving belt;

a container comprising: a first housing portion that houses the developer scraped off by the first scraping member, as a recovered material; and a second housing portion that houses the residuals scraped off by the second scraping member;

a discharge port that is disposed in the first housing portion, wherein the developer in the first housing portion is discharged to an outside of the container through the discharge port; and a conveying member that conveys the recovered material housed in the first housing portion to the discharge port; wherein a partitioning member that partitions the container into the first housing portion and the second housing portion is disposed in the container at a position below both of a position where the first scraping member contacts with the moving belt and a position where the second scraping member contacts with the moving belt.

2. The cleaning device according to claim 1, wherein the first scraping member is configured by an elastic material, and the second scraping member is configured by a material that is lower in elasticity than the first scraping member.

3. The cleaning device according to claim 1, wherein the residuals housed in the second housing portion are not discharged to an outside of the container.

4. An image forming apparatus comprising:

a moving belt that circularly moves;

a blade-shaped first scraping member that scrapes off a developer on a surface of the moving belt;

a blade-shaped second scraping member that is disposed downstream from the first scraping member in a moving direction of the moving belt and is oriented in a plane parallel to the first scraping member, and that scrapes off residuals remaining on the surface of the moving belt;

a container comprising: a first housing portion that houses the developer scraped off by the first scraping member, as a recovered material; and a second housing portion that houses the residuals scraped off by the second scraping member;

a discharge port that is disposed in the first housing portion, wherein the developer in the first housing portion is discharged to an outside of the container through the discharge port;

a conveying member that conveys the recovered material housed in the first housing portion to the discharge port, wherein the residuals housed in the second housing portion are not discharged to an outside of the container, and a partitioning member that partitions the container into the first housing portion and the second housing portion is disposed in the container at a position below both of a position where the first scraping member contacts with the moving belt and a position where the second scraping member contacts with the moving belt.

5. A cleaning device comprising:

a blade-shaped first scraping member that scrapes off a developer on a surface of a moving belt that circularly moves;

a blade-shaped second scraping member that is disposed downstream from the first scraping member in a moving direction of the moving belt and is oriented in a plane parallel to the first scraping member, and that scrapes off residuals remaining on the surface of the moving belt;

a container comprising:

a first housing portion that houses the developer scraped off by the first scraping member, as a recovered material; and a second housing portion that houses the residuals scraped off by the second scraping member;

a discharge port that is disposed in the first housing portion, wherein the developer in the first housing portion is discharged to an outside of the container through the discharge port;

a conveying member that conveys the recovered material housed in the first housing portion to the discharge port, and a rotary brush that is disposed upstream from the first scraping member in the moving direction of the moving belt and contacts with a surface of the moving belt; wherein a partitioning member that partitions the container into the first housing portion and the second housing portion is disposed in the container at a position below both of a position where the first scraping member contacts with the moving belt and a position where the second scraping member contacts with the moving belt.

6. The cleaning device according to claim 5, which further comprises a third scraping member that is disposed upstream from the rotary brush in the moving direction of the moving belt, and that scrapes off the developer on the surface of the moving belt.

7. The cleaning device according to claim 5, wherein the first scraping member is configured by an elastic material, and the second scraping member is configured by a material that is lower in elasticity than the first scraping member.

8. The cleaning device according to claim 5, wherein the residuals housed in the second housing portion are not discharged to an outside of the container.

* * * * *